US010690459B1

(12) United States Patent
Sherlock et al.

(10) Patent No.: US 10,690,459 B1
(45) Date of Patent: Jun. 23, 2020

(54) DETONATION-WAVE-SHAPING FUZE BOOSTER

(71) Applicant: The United States of America as Represented by the Secretary of the Navy, Indian Head, MD (US)

(72) Inventors: Mary H. Sherlock, Waldorf, MD (US); Brian A. Cole, King George, VA (US); Kyle M. Beckett, Pomfret, MD (US); Joshua E. Felts, Indian Head, MD (US); Forrest R. Svingala, Los Alamos, NM (US); Reid M. McKeown, Clarksville, MD (US); Harold W. Sandusky, Fulton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 117 days.

(21) Appl. No.: 15/932,603

(22) Filed: Mar. 23, 2018

(51) Int. Cl.

| | |
|---|---|
| ***A42B 3/22*** | (2006.01) |
| ***F42B 1/024*** | (2006.01) |
| ***F42C 19/08*** | (2006.01) |
| ***F42C 19/09*** | (2006.01) |
| ***F42B 3/22*** | (2006.01) |
| *F42B 1/032* | (2006.01) |

(52) U.S. Cl.
CPC ..... *F42B 3/22* (2013.01); *F42B 1/024* (2013.01); *F42C 19/0807* (2013.01); *F42C 19/09* (2013.01); *F42B 1/032* (2013.01); *F42C 19/0823* (2013.01); *F42C 19/0838* (2013.01)

(58) Field of Classification Search
CPC .. F42B 1/00; F42B 1/024; F42B 1/032; F42B 1/04; F42B 3/22; F42C 19/08; F42C 19/09; F42C 19/0807; F42C 19/0823; F42C 19/0838
USPC ..... 102/305, 309
See application file for complete search history.

(56) References Cited

U.S. PATENT DOCUMENTS

| | | | | |
|---|---|---|---|---|
| 4,050,381 | A * | 9/1977 | Heinemann | F42B 1/024 102/387 |
| 4,425,850 | A | 1/1984 | Grossler | |
| 4,665,826 | A * | 5/1987 | Marer | F42B 1/024 102/401 |
| 4,672,896 | A | 6/1987 | Precoul et al. | |
| 4,711,181 | A | 12/1987 | Ringel et al. | |
| 4,875,414 | A | 10/1989 | Stadler et al. | |
| 4,982,662 | A * | 1/1991 | Beck | F42B 3/10 102/205 |

(Continued)

*Primary Examiner* — James S Bergin
(74) *Attorney, Agent, or Firm* — Fredric J. Zimmerman

(57) ABSTRACT

A fuze booster includes a first explosive charge having a cavity with an annular portion of the first explosive charge encircling a first axial portion of the cavity and a semi-annular portion partially encircling a second axial portion of the cavity. The annular portion abuts the semi-annular portion. An explosively-inert material abuts the semi-annular portion, abuts the annular portion, and partially encircles the second axial portion of the cavity. A second explosive charge abuts the explosively-inert material, abuts the semi-annular portion, and partially encircles the second axial portion of the cavity. The second axial portion of the cavity is thus completely encircled by a combination of the semi-annular portion, the explosively-inert material, and the second explosive charge.

20 Claims, 4 Drawing Sheets

(56) References Cited

U.S. PATENT DOCUMENTS

| | | | | |
|---|---|---|---|---|
| 5,204,493 | A * | 4/1993 | Christmann | F42B 1/024 102/307 |
| 5,221,810 | A | 6/1993 | Spahn | |
| 5,259,317 | A | 11/1993 | Lips | |
| 7,752,972 | B1 | 7/2010 | Baker et al. | |
| 8,037,822 | B2 * | 10/2011 | Althof | F42B 1/024 102/202.14 |
| 8,056,478 | B2 * | 11/2011 | Berlin | F42B 3/22 102/275.11 |
| 8,272,326 | B2 | 9/2012 | Berlin et al. | |
| 9,291,435 | B2 * | 3/2016 | Scheid | F42B 1/02 |
| 9,903,692 | B2 * | 2/2018 | Arnold | F42B 12/22 |
| 10,048,047 | B2 * | 8/2018 | Van Niekerk | F42B 3/22 |
| 2013/0061771 | A1 * | 3/2013 | Betancourt | F42B 3/08 102/307 |
| 2016/0216085 | A1 * | 7/2016 | Scheid | F42B 3/22 |
| 2019/0107371 | A1 * | 4/2019 | Grace | F42B 1/028 |

* cited by examiner

DETONATION-WAVE-SHAPING FUZE BOOSTER

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to explosive fuzes, and more particularly to an explosive fuze booster incorporating detonation-wave shaping features.

BACKGROUND OF THE INVENTION

Many aircraft-delivered bombs have what is known as a fuze well centrally positioned in either the bomb's nose or the bomb's tail. An electronic fuze is seated in one of these fuze wells. Electric and communications lines are led to the electronic fuze through a conduit extending through the bomb to the fuze well. The electronic fuze includes a fuze booster that is generally an annularly-shaped element to accommodate the passage of the aforementioned electric and communications lines on their way to the fuze's safe-and-arming mechanism. The annular shape of the fuze booster necessitates that its initiation is off-center in what is known as a side-light initiation. While such side-light initiation is satisfactory for conventional-explosive bomb fills, side-light initiation has been less effective at fully initiating highly-insensitive-explosive bomb fills.

SUMMARY OF THE INVENTION

Accordingly, it is an object of the present invention to provide an annularly-shaped fuze booster configured for side-light initiation to achieve an effective initiation of highly insensitive explosives.

Other objects and advantages of the present invention will become more obvious hereinafter in the specification and drawings.

In accordance with the present invention, a fuze booster includes a first explosive charge having a cavity extending there through. The first explosive charge has an annular portion encircling a first axial portion of the cavity and has a semi-annular portion partially encircling a second axial portion of the cavity. The annular portion abuts the semi-annular portion. An explosively-inert material abuts the semi-annular portion, abuts the annular portion, and partially encircles the second axial portion of the cavity. A second explosive charge abuts the explosively-inert material, abuts the semi-annular portion, and partially encircles the second axial portion of the cavity. As a result, the second axial portion of the cavity is completely encircled by a combination of the semi-annular portion, the explosively-inert material, and the second explosive charge.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
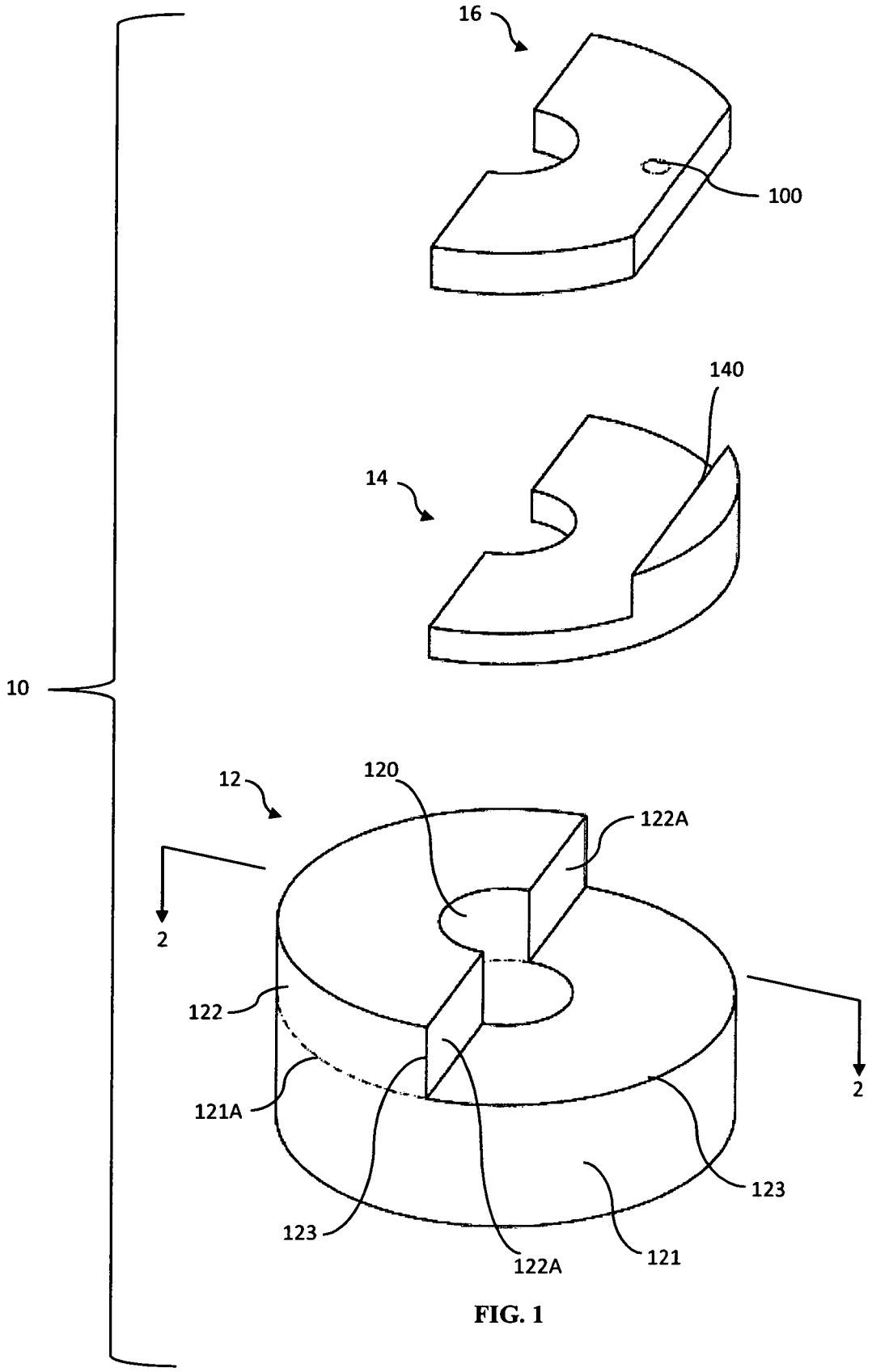
FIG. 1 is an exploded view of a detonation-wave-shaping booster fuze in accordance with an embodiment of the present invention.
Figure 2:
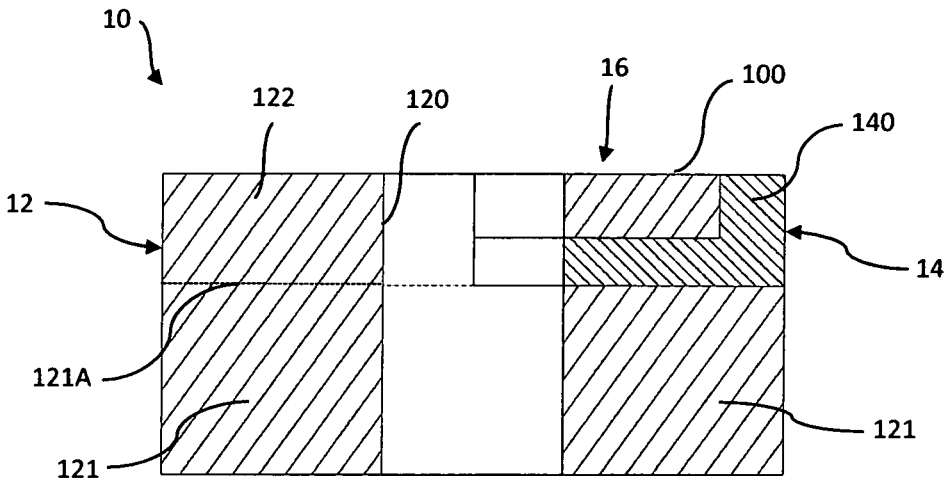
FIG. 2 is an axial cross-sectional view of the detonation-wave-shaping booster fuze shown in FIG. 1 in its assembled form.

Referring now to the drawings, simultaneous reference will be made to FIGS. 1 and 2 where a detonation-wave-shaping fuze booster in accordance with an embodiment of the present invention is shown and is referenced generally by numeral 10. More specifically, FIG. 1 illustrates fuze booster 10 in an exploded view and FIG. 2 illustrates an assembled form of fuze booster 10 in a cross-sectional view taken along line 2-2 in FIG. 1. As illustrated, fuze booster 10 is a generally an annularly-shaped cylindrical assembly for use in a cylindrical fuze well (not shown). However, it is to be understood that the outer shape of the fuze booster may be tailored to fit in other shapes of fuze wells without departing from the scope of the present invention.

Fuze booster 10 includes an explosive main booster charge 12, a detonation-wave-shaping element 14, and an explosive transfer charge 16. These three elements are assembled in an abutting relationship illustrated in FIG. 2. As will be explained further below, transfer charge 16 is initiated by a side-light detonator (not shown) at an axial off-center location on fuze booster 10 that is indicated by numeral 100.

Main booster charge 12 is a solid high-explosive material (e.g., PBXN-7, PBXN-5, PBXN-9 or PBXN-12) that can be molded, printed, injection-loaded or cast to have a cavity 120 extending axially through a central portion thereof. Cavity 120 provides a "conduit" through fuze booster 10 for electric and communication lines (not shown). Main booster charge 12 has an annular portion 121 that completely encircles cavity 120 and has a semi-annular portion 122 that partially encircles cavity 120, e.g., encircling approximately one-half of cavity 120 in the illustrated embodiment. Portions 121 and 122 abut one another along cavity 120 as indicated by dashed line 121A. That is, in terms of a solid molded, pressed, printed, injection-loaded or cast high-explosive main booster charge 12, portions 121 and 122 are integrated with one another. The resulting ledge 123 defined in main booster charge 12 is filled with the combination of detonation-wave-shaping element 14 and transfer charge 16.

Detonation-wave-shaping element 14 (or "wave-shaping element 14" as it will be referred to hereinafter) is made from an explosively-inert material such as plastic, felt, rubber or wood. Wave-shaping element 14 may be a solid, hollow, porous or foamed material without departing from the scope of the present invention. In general and as will be explained further below, wave-shaping element 14 shapes the detonation wave associated with a side-lit initiated transfer charge 16 to provide an effective initiation of main booster charge 12.

Wave-shaping element 14 fits on/in ledge 123 and axially abuts annular portion 121 and the internally-facing diametrical edge 122A of semi-annular portion 122 of main booster charge 12, while also partially encircling cavity 120. In the illustrated embodiment, wave-shaping element 14 includes backstop region 140 against which transfer charge 16 rests. Backstop region 140 holds transfer charge 16 in place and directs the detonation wave of an initiated transfer charge 16 towards semi-annular portion 122.

Transfer charge 16 is a solid, molded, pressed, printed, injection-loaded or cast piece of high-explosive material (e.g., PBXN-7, PBXN-5, PBXN-9 or PBXN-12) abutting wave-shaping element 14 and the internally-facing diametrical edge 122A of semi-annular portion 122 such that transfer charge 16 partially encircles a portion of cavity 120 passing through semi-annular portion 122. In this way, cavity 120 is completely encircled in-part by annular portion 120 and in-part by the combination of semi-annular portion 122, wave-shaping element 14, and transfer charge 16.

Figure 3:
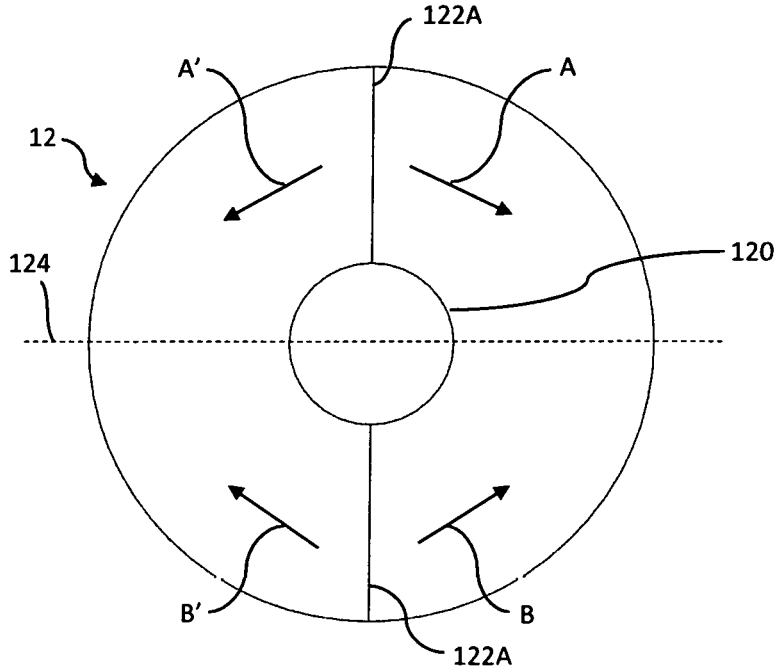
FIG. 3 is a diagrammatic view of the main booster charge illustrating the propagation path and cooperation of detonation waves resulting from the fuze booster of the present invention.

When transfer charge 16 undergoes a side-lit initiation at point 100, wave-shaping element 14 directs the resulting detonation wave towards radial edge 122A of semi-annular portion 122. As shown in FIG. 3, the initiation of main booster charge 12 thus occurs along diametrical edge 122A (illustrated by a solid line in FIG. 3), and then propagates into annular portion 121 along opposing paths A/A' and B/B' on both sides of cavity 120. The detonation waves on paths A and B cooperate/merge along a line 124 perpendicular to edge 122A, while the detonation waves on paths A' and B' cooperate/merge along line 124 but 180° away from the cooperation/merging of detonation waves on paths A and B. The diametrically-opposed locations of detonation wave merging and cooperation creates brief and narrow high-pressure jets at the two diametrically-opposing locations along line 124. The two diametrically-opposing jetting events provide two nearly symmetric initiation points of main booster charge 12 that, once detonated, will transfer its detonation wave energy to an intermediate auxiliary booster (not shown) or main bomb fill (not shown) for efficient detonation thereof.

Figure 4:
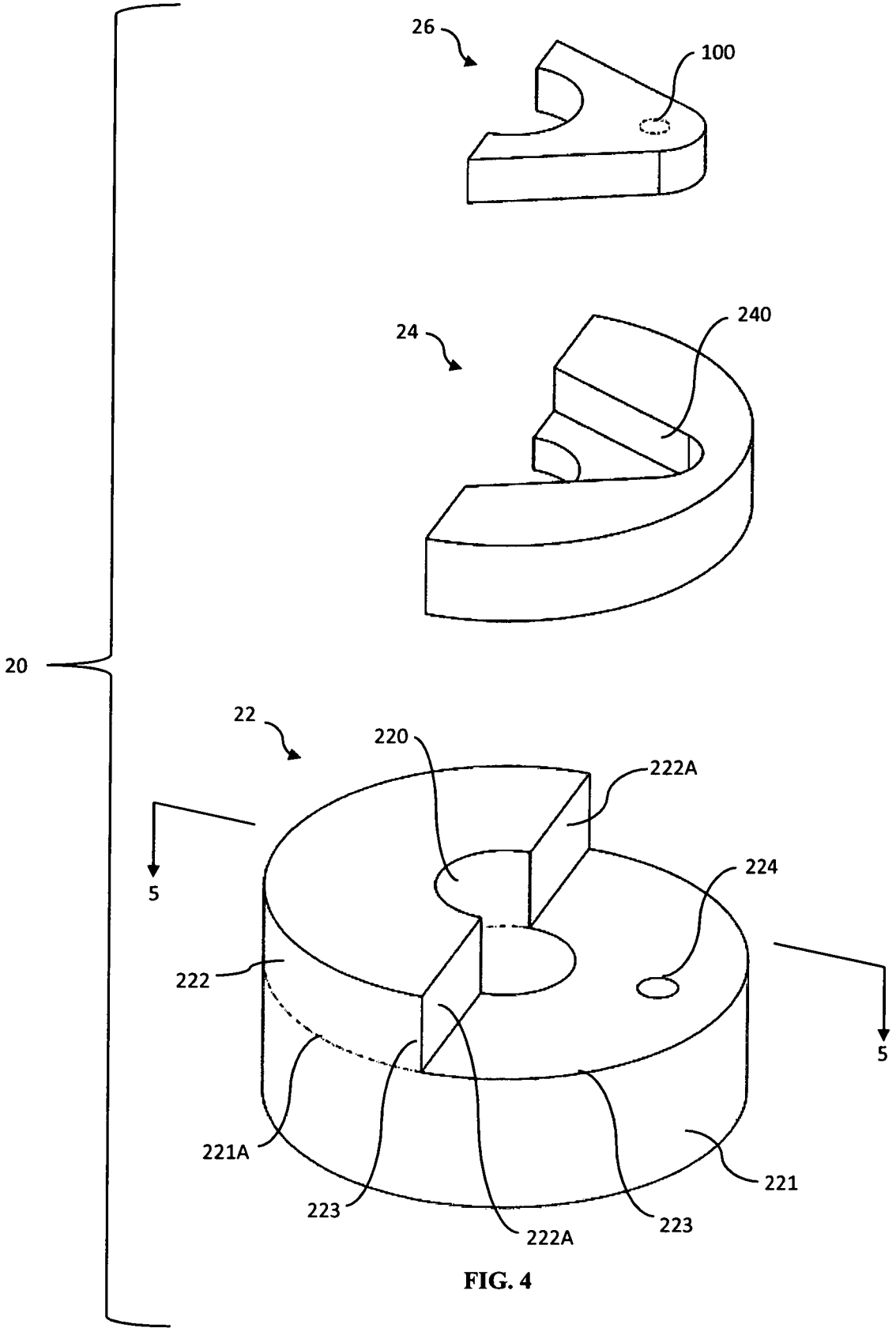
FIG. 4 is an exploded view of a detonation-wave-shaping booster fuze in accordance with another embodiment of the present invention.
Figure 5:
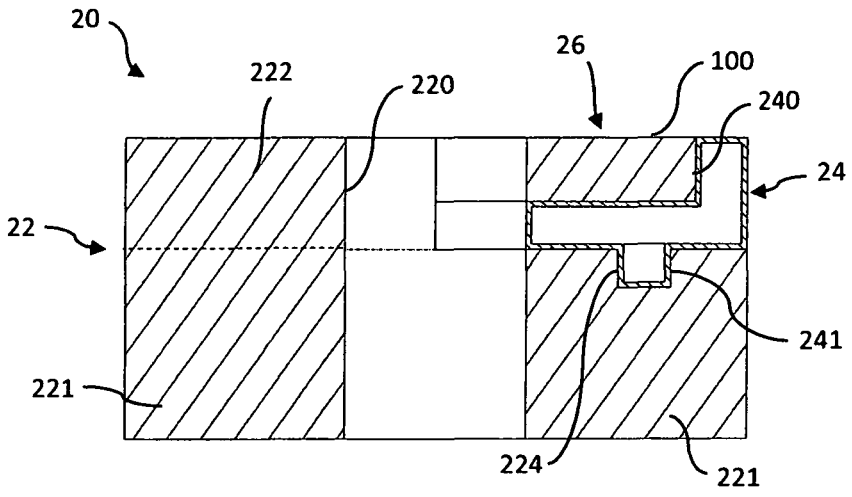
FIG. 5 is an axial cross-sectional view of the detonation-wave-shaping booster fuze shown in FIG. 2 in its assembled form.

Another embodiment of a fuze booster in accordance with the present invention is illustrated in FIGS. 4-5 and is referenced generally by numeral 20. More Specifically, FIG. 4 illustrates fuze booster 20 in an exploded view and FIG. 5 illustrates an assembled form of fuze booster 20 in a cross-sectional view taken along line 5-5 in FIG. 4. Similar to the previously-described embodiment, fuze booster 20 includes an explosive main booster charge 22, a detonation-wave-shaping element 24, and a side-lit initiated explosive transfer charge 26. The three elements are assembled in an abutting relationship in FIG. 5. A side-light detonator (not shown) would be used to initiate transfer charge 26 at axial off-center location 100.

Main booster charge 22 is analogous to the previously-described main booster charge 12 such that the analogous features of a cavity 220, an annular portion 221 abutting (at 221A) a semi-annular portion 222 defining a diametrical edge 222A, and a ledge 223 need not be described further herein. Main booster charge 22 further includes an axially-extending socket 224 formed in an axial end of annular portion 221 that is aligned with side-lit initiation point 100. Socket 224 provides for the indexing of wave-shaping element 24 to main booster charge 22. In addition, by aligning socket 224 with initiation point 100, a larger wave-shaping gap is provided between transfer charge 26 and main booster charge 22 to prevent shock transfer through wave-shaping element 24 caused by detonation of transfer charge 26 at initiation point 100. Additional sockets can be provided in annular portion 221 for indexing purposes without departing from the scope of the present invention.

Wave-shaping element 24 is a hollow structure (e.g., made from an explosively-inert material such as plastic, felt, rubber, or wood) that fits into/on ledge 223 and functions similarly to wave-shaping element 14 described above. However, rather than having a simple backstop region, wave-shaping element 24 defines a wedge-shaped nest region 240 for receiving transfer charge 26. Transfer charge 26 is correspondingly wedge-shaped to nest in region 240. In addition, wave-shaping element 24 includes a hollow pin 241 (only visible in FIG. 5) that fits into socket 224 of annular portion 221 where hollow pin 241 is axially aligned with initiation point 100.

The advantages of the present invention are numerous. The fuze booster provides a new arrangement of explosive charges and a detonation-wave-shaping element to generate diametrically-opposed jet initiations that provide for more efficient detonation of even insensitive explosive fills.

Although the invention has been described relative to a specific embodiment thereof, there are numerous variations and modifications that will be readily apparent to those skilled in the art in light of the above teachings. For example, various adhesives and/or mechanical fasteners, springs, etc., could be included in the fuze booster to facilitate its assembly and/or parts retention without departing from the scope of the present invention. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A fuze booster, comprising:

a first explosive charge having a cavity extending there through, said first explosive charge includes an annular portion encircling a first axial portion of said cavity and a semi-annular portion partially encircling a second axial portion of said cavity, wherein said annular portion abuts said semi-annular portion;

an explosively-inert material abutting said semi-annular portion, abutting said annular portion, and partially encircling said second axial portion of said cavity; and a second explosive charge abutting said explosively-inert material, abutting said semi-annular portion, and partially encircling said second axial portion of said cavity, wherein said second axial portion of said cavity is completely encircled by a combination of said semi-annular portion, said explosively-inert material, and said second explosive charge.

2. The fuze booster as in claim 1, wherein said annular portion and said semi-annular portion are integrated with one another.

3. The fuze booster as in claim 1, wherein said cavity is centrally positioned in said first explosive charge.

4. The fuze booster as in claim 1, wherein said explosively-inert material is selected from the group consisting of plastics, foam, felt, rubber and wood.

5. The fuze booster as in claim 1, wherein said explosively-inert material is selected from the group consisting of solid materials, hollow materials, and foam materials.

6. The fuze booster as in claim 1, wherein said explosively-inert material is indexed into said annular portion.

7. The fuze booster as in claim 1, wherein said second explosive charge is nested in said explosively-inert material.

8. The fuze booster as in claim 7, wherein said second explosive charge is wedge-shaped.

9. A fuze booster, comprising:

a first explosive charge including a cavity centrally-positioned therein and extending there through, said first explosive charge includes an annular portion integrated with a semi-annular portion, said annular portion encircles a first axial portion of said cavity and said semi-annular portion partially encircles a second axial portion of said cavity;

an explosively-inert material abutting said semi-annular portion, abutting said annular portion, and partially encircling said second axial portion of said cavity; and a second explosive charge abutting said explosively-inert material, abutting said semi-annular portion, and partially encircling said second axial portion of said cavity, wherein said second axial portion of said cavity is completely encircled by a combination of said semi-annular portion, said explosively-inert material, and said second explosive charge.

10. The fuze booster as in claim 9, wherein said explosively-inert material is selected from the group consisting of plastics, foam, felt, rubber and wood.

11. The fuze booster as in claim 9, wherein said explosively-inert material is selected from the group consisting of solid materials, hollow materials, and foam materials.

12. The fuze booster as in claim 9, wherein said explosively-inert material is indexed into said annular portion.

13. The fuze booster as in claim 9, wherein said second explosive charge is nested in said explosively-inert material.

14. The fuze booster as in claim 13, wherein said second explosive charge is wedge-shaped.

15. A fuze booster, comprising:

a first explosive charge including a cavity extending there through, said first explosive charge includes an annular portion encircling a first axial portion of said cavity and a semi-annular portion partially encircles a second axial portion of said cavity, wherein said annular portion abuts said semi-annular portion;

a hollow detonation-wave-shaping element made from an explosively-inert material, said detonation-wave-shaping element abuts said semi-annular portion, abuts and indexed to said annular portion, and partially encircles said second axial portion of said cavity; and a second explosive charge abutting said detonation-wave-shaping element, abutting said semi-annular portion, and partially encircling said second axial portion of said cavity, wherein said second axial portion of said cavity is completely encircled by a combination of said semi-annular portion, said detonation-wave-shaping element, and said second explosive charge.

16. The fuze booster as in claim 15, wherein said annular portion and said semi-annular portion are integrated with one another.

17. The fuze booster as in claim 15, wherein said cavity is centrally positioned in said first explosive charge.

18. The fuze booster as in claim 15, wherein said detonation-wave-shaping element comprises a plastic material.

19. The fuze booster as in claim 15, wherein said second explosive charge is nested in said detonation-wave-shaping element.

20. The fuze booster as in claim 19, wherein said second explosive charge is wedge-shaped.

* * * * *